United States Patent [19]

Morrisette

[11] 4,305,469

[45] Dec. 15, 1981

[54] FIRE EXTINGUISHING SYSTEM HAVING A DISCHARGE VALVE AND A DISTRIBUTION VALVE ACTUATED BY A PNEUMATIC ACTUATOR

[75] Inventor: Milton J. Morrisette, Ashland, Mass.

[73] Assignee: Walter Kidde and Company, Inc., Clifton, N.J.

[21] Appl. No.: 166,058

[22] Filed: Jul. 7, 1980

[51] Int. Cl.[3] ..... A62C 37/06

[52] U.S. Cl. ..... 169/61; 137/625.18; 137/628; 169/16; 169/20; 251/63.4

[58] Field of Search ..... 169/16, 17, 20, 60, 169/61; 239/67, 533.1; 251/63, 63.4, 63.5; 137/625.18, 628; 222/130, 504

[56] References Cited

U.S. PATENT DOCUMENTS

| | | | |
|---|---|---|---|
| 1,724,891 | 8/1929 | Anderson | 251/63.5 |
| 3,865,192 | 2/1975 | Dunphy | 169/61 |
| 3,949,812 | 4/1976 | Hay | 169/61 |
| 4,082,148 | 4/1978 | Wilms | 169/61 |

*Primary Examiner*—Robert J. Spar

*Assistant Examiner*—Fred A. Silverberg

*Attorney, Agent, or Firm*—John E. Toupal

[57] ABSTRACT

A fire protection system including a discharge valve for discharging a pressurized extinguishing agent from a storage container into a distribution manifold. Discharge of the agent is induced by a pneumatic release mechanism that responds to the application of fluid pressure. Mounted in predetermined protection zones are a plurality of discharge nozzle arrays, each connected to the outlet of a distribution valve, the inlet of which is connected to the distribution manifold. Each distribution valve comprises a valve closure movable between a closed position that seals the valve inlet from the valve outlet and an open position that permits fluid flow therebetween, a pneumatic actuator for moving the valve closure to the open position in response to the presence of fluid pressure and a fluid pressure transfer mechanism that transmits fluid pressure from the actuator to the discharge valve release mechanism in response to movement of the valve closure to its open position.

11 Claims, 3 Drawing Figures

FIRE EXTINGUISHING SYSTEM HAVING A DISCHARGE VALVE AND A DISTRIBUTION VALVE ACTUATED BY A PNEUMATIC ACTUATOR

BACKGROUND OF THE INVENTION

This invention relates generally to a fire protection system, and more particularly, to a system in which a central supply of a pressurized extinguishing agent is connected to a plurality of protected zones by individually controlled, pressure responsive valves.

Many fire protection systems employ a single central supply of a pressurized fire extinguishing agent to protect a plurality of individually isolated zones. Generally, each of the zones is connected by a selectively controlled distribution valve to a supply manifold that in turn is connected to the central supply by a single discharge valve. In such systems it is highly important that the operation of both the central discharge valve and the individual distribution valves be fast, safe, and reliable.

The object of this invention, therefore, is to provide an improved first protection system of the type that utilizes a central supply of pressurized extinguishing agent to protect selectively a plurality of isolated zones.

SUMMARY OF THE INVENTION

The invention is a fire protection system including a discharge valve for discharging a pressurized extinguishing agent from a storage container into a distribution manifold. Discharge of the agent is induced by a pneumatic release mechanism that responds to the application of fluid pressure. Mounted in predetermined protection zones are a plurality of discharge nozzle arrays, each connected to the outlet of a distribution valve, the inlet which is connected to the distribution manifold. Each distribution valve comprises a valve closure movable between a closed position that seals the valve inlet from the valve outlet and an open position that permits fluid flow therebetween, a pneumatic actuator for moving the valve closure to the open position in response to the presence of fluid pressure and a fluid pressure transfer mechanism that transmits fluid pressure from the actuator to the discharge valve release mechanism in response to movement of the valve closure to its open position. The distribution valve transfer mechanism insures that the discharge valve is opened only after the opening of a given distribution valve in response to the detection of fire in a zone associated therewith.

In a featured embodiment of the invention, the distribution valve comprises a valve housing; the transfer mechanism comprises an outlet port defined by the valve housing and connected for fluid communication with the discharge release valve mechanism; and each distribution valve actuator mechanism comprises a valve housing inlet port for receiving activating fluid pressure and an activator member sealing the inlet port from the outlet port with the valve closure in its closed position and providing fluid communication therebetween with the valve closure in its open position. Preferably, the valve housing further defines a cylinder communicating with the inlet port and the activator member is a piston slidably contained within the cylinder. The piston normally seals the inlet port from the outlet port, but in response to the application of fluid pressure, moves in the cylinder to both force open the valve closure and provide fluid communication between the inlet and outlet ports which thereby transmit fluid pressure to the discharge valve release mechanism.

According to another feature of the invention, the valve closure is a shuttle member normally in a closed position engaging a valve seat defined by the valve housing and movable into an open position within a chamber also defined by the valve housing. The shuttle member when in its closed position, includes a closure wall portion that seals the distribution valve inlet from its outlet and a divider wall portion with an outer portion that closes the opening to the chamber. In addition, the valve housing defines a pressure port that provides fluid communication between the shuttle chamber and the valve inlet with the shuttle in its closed position, but that is closed by the shuttle member in response to movement thereof out of its closed position. In response to opening of the discharge valve to establish fluid pressure in the manifold, the pressure port in each unopened distribution valve transmits fluid pressure into the shuttle receiving chamber that prevents movement of the shuttle member into its open position. Conversely, manifold pressure communicating with an opened distribution valve produces a fluid pressure on an inner surface of the divider wall portion so as to maintain that shuttle member in its open position.

DESCRIPTION OF THE DRAWINGS

These and other objects and features of the invention will become more apparent upon a perusal of the following description taken in conjunction with the accompanying drawings wherein.

DESCRIPTION OF THE PREFERRED EMBODIMENT

Figure 1:
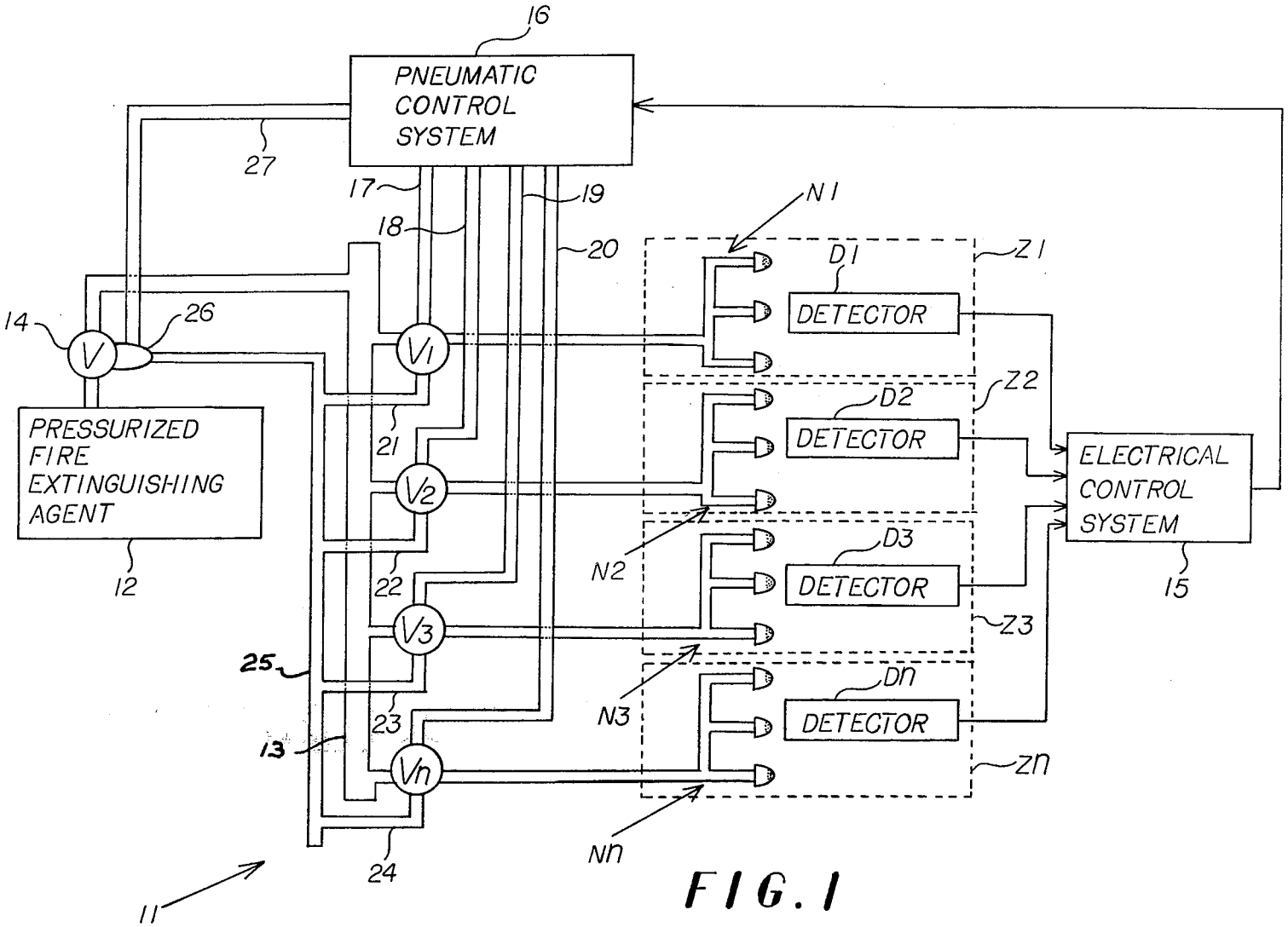
FIG. 1 is a schematic diagram of a fire extinguishing system according to the invention.

Illustrated in FIG. 1 is a fire protection system 11 including a source of pressurized fire extinguishing agent 12 connected to a discharge manifold 13 by a discharge valve 14. A suitable extinguishing agent for use in the system 11 is, for example, bromotrifluoroethane marketed under the trademark HALON 1301 by the E. I. duPont Nemours Company. Also included in the system 11 are a plurality of discharge nozzle arrays N1, N2, N3, and Nn, each connected for fluid communication with the distribution manifold 13 by, respectively, a distinct distribution valve V1, V2, V3, and Vn. Each of the nozzle arrays N1–Nn is located, respectively, in a distinct zone Z1, Z2, Z3 and Zn of a complete fire protected region. Positioned to detect fire in each of the zones Z1–Zn, respectively, is a fire detector D1, D2, D3 and Dn, all of which supply fire detection signals to an electrical control system 15. A pneumatic control system 16 responds to control signals from the electrical control system by selectively providing on lines 17–20 fluid pressure signals to the distribution valves V1–Vn. Fluid pressure outlets from the valves V1–Vn are transmitted by lines 21–24 to a release manifold 25 that also is connected to a pneumatic release mechanism 26 for the discharge valve 14. A fluid return line 27 connects the pneumatic release 26 to the pneumatic control system 16.

Figure 2:
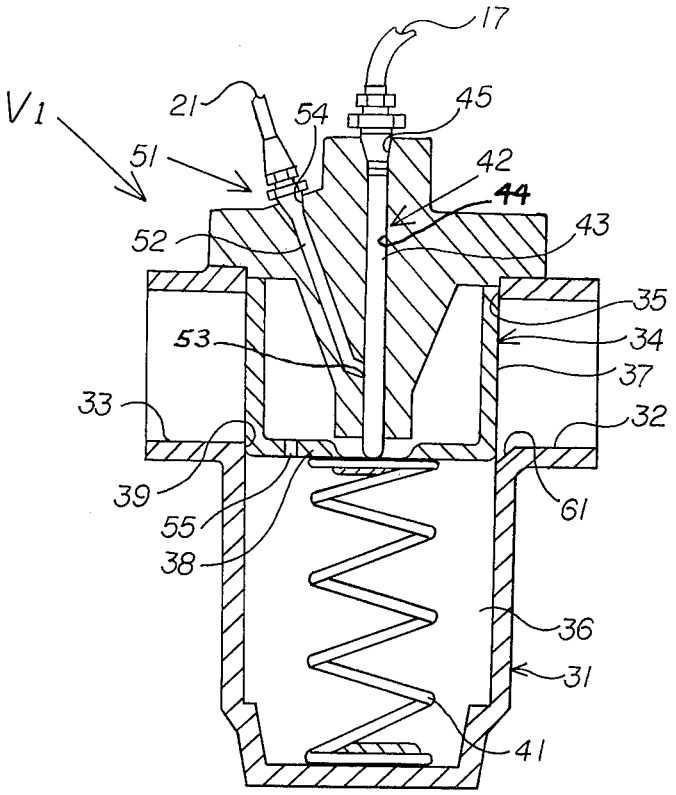
FIG. 2 is a schematic cross-sectional view of a distribution valve used in the system of FIG. 1 and shown in a closed position.

Referring now to FIG. 2 there is shown in schematic cross-section the distribution valve V1 illustrated in FIG. 1. It should be understood that both the structural features and operation of the other distribution valves V2–Vn are identical to those of the distribution valve V1 shown in FIG. 2. A valve housing 31 defines an inlet 32 connected to the discharge manifold 13 and an outlet 33 connected to the nozzle array N1. Retained by the housing 31 is a valve closure shuttle member 34 that moves between a closed position against a seat 35 and an open position within a chamber 36. With the valve closure 34 in the closed position shown in FIG. 1, closure wall portions 37 thereof seal the inlet 32 from the outlet 33 while a divider wall portion 38 thereof closes an opening 39 in the chamber 36. Mounted within the chamber 36 is a spring member 41 that biases the shuttle member 34 into its closed position.

Figure 3:
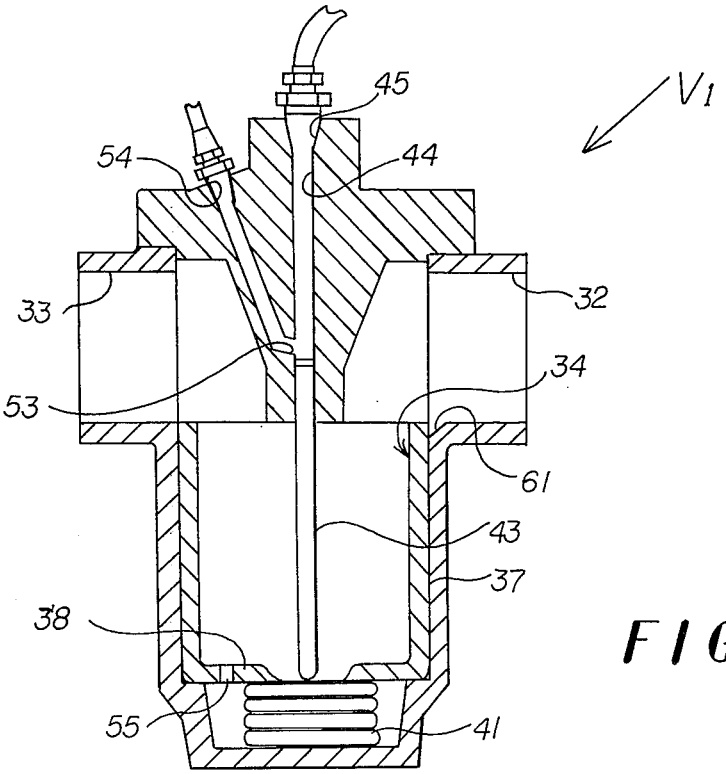
FIG. 3 is a schematic cross-sectional view of the distribution valve of FIG. 2 shown in a fully open position.

Included in the distribution valve V1 is a pneumatic actuator mechanism 42 for moving the shuttle member 34 from the closed position shown in FIG. 2 to the open position shown in FIG. 3. The pneumatic actuator mechanism 42 comprises an activator piston 43, piston accommodating a cylinder 44 defined by the housing 31, and an inlet port 45 also defined by the housing 31 and providing fluid communication between the cylinder 44 and the inlet line 17. Another portion of the distribution valve V1 is a fluid pressure transfer mechanism 51 that transfers fluid pressure from the pneumatic control system 16 to the pneumatic release 26 of the discharge valve 14. The pressure transfer mechanism 51 comprises a channel 52 defined by the valve housing 31 and extending between the outlet line 21 and an orifice 53 opening into the lower portion of the channel 44.

During operation of the protection system 11, the detectors D1–Dn function in a conventional manner to detect products of combustion generated within the zones Z1–Zn. For example, in response to a fire condition in zone Z1, the detector D1 transmits an alarm signal to the electrical control system 15 which in turn supplies an appropriate control signal to the pneumatic control system 16. In response to that signal, the pneumatic control system 16 induces fluid pressure in the line 17 that is received at the inlet port 45 of the distribution valve V1. The presence of fluid pressure at the inlet 45 forces the piston 43 downwardly in the cylinder 44 moving the shuttle member 34 through the opening 39 into the chamber 36 as shown in FIG. 3. During this movement of the shuttle member 34, air within the chamber 36 escapes through a vent 55 in the divider wall portion 38. With the shuttle member 34 in its open position within the chamber 36, a fluid communication path is provided between the inlet 32 and the outlet 33 of the distribution valve V1. In addition, the activator piston 43 is positioned below the orifice 53 so as to establish fluid communication between the inlet port 45 and the outlet port 54 via the cylinder 44 and the channel 52. Thus, fluid pressure supplied by the pneumatic control system 16 is transferred through the line 21 and the release manifold 25 to the pneumatic release 26 which opens the discharge valve 14. The opening of the discharge valve 14 permits the flow of extinguishing agent from the container 12 into the manifold 13, through the opened distribution valve V1 and out of the nozzle array N1 into the zone Z1 in which a fire was detected. It will be apparent that the detection of fire in any of the other zones Z2–Zn will result similarly in the discharge of extinguishing agent thereinto.

Referring again to FIG. 2, the valve housing 31 defines a pressure port 61 that establishes fluid communication between the valve inlet 32 and the chamber 36 with the valve closure 34 in its closed position. Therefore, upon the establishment of extinguishing agent pressure within the distribution manifold 13 in response to the above described opening of the distribution valve V1, that pressure is transmitted by the pressure ports 61 into the chambers 36 of the unopened distribution valves V2–Vn. The resultant force applied against the outer surfaces of the divider wall portions 38 insures that the unopened shuttle members 34 of the distribution valve V2–Vn remain in their closed positions. Conversely, as shown in FIG. 3, the pressure port 61 in the opened distribution valve V1 is closed by movement of its shuttle member 34 out of its closed position to prevent the flow of pressurized extinguishing agent into its chamber 36. Consequently, the pressurized extinguishing agent in the opened valve V1 exerts a force on the inner surface of the divider wall portion 38 to maintain its shuttle member 34 in its open position.

Obviously, many modifications and variations of the present invention are possible in light of the above teachings. It is therefore to be understood that within the scope of the appended claims, the invention can be practised otherwise than as specifically described.

What is claimed is:

1. A fire protection system comprising:

a storage container means defining a discharge opening and filled under pressure with an extinguishing agent;

discharge valve means closing said discharge opening and including a pneumatic release means for opening said discharge valve means to release said extinguishing agent in response to an application of fluid pressure;

a distribution manifold connected to said discharge valve means;

a plurality of distribution valves each having an inlet connected to said manifold, each of said distribution valves comprising a valve closure movable between a closed position that seals said inlet from an outlet and an open position that permits fluid flow therebetween, pneumatic actuator means for moving said valve closure to said open position in response to an application of fluid pressure, and fluid pressure transfer means for transmitting said fluid pressure from said actuator means to said release means in response to movement of said valve closure to said open position; and a plurality of discharge nozzle means each connected to said outlet of a different one of said distribution valves and located in a different zone to be protected.

2. A system according to claim 1 wherein each said distribution valve comprises a housing means; said transfer means comprises an outlet port defined by said housing means and connected for fluid communication with said release means; and said actuator means comprises an inlet port defined by said housing means and receiving said fluid pressure, and an activator means sealing said inlet port from outlet port with said valve closure in said closed position and providing fluid communication therebetween with said valve closure in said open position.

3. A system according to claim 2 wherein said valve closure comprises a shuttle member reciprocable between said open and closed positions, and said housing means defines a valve seat accommodating said shuttle member in said closed position and a chamber receiving said shuttle member in said open position, said chamber having an opening through which said shuttle member moves.

4. A system according to claim 3 wherein said shuttle member comprises a closure wall portion that seals said inlet from said outlet when in said closed position, and a divider wall portion with an outer surface that closes said opening when in said closed position.

5. A system according to claim 4 wherein said housing means defines a pressure port providing fluid communication between said chamber and said inlet with said shuttle member in said closed position, said pressure port is closed by said shuttle member in response to movement thereof out of said closed position, and an inner surface of said divider wall portion is sealed from said inlet with said shuttle means in said closed position.

6. A system according to claim 5 wherein movement of said shuttle means to said open position establishes fluid communication between said inlet and said inner portion of said divider wall.

7. A system according to claim 6 wherein said housing means defines a cylinder communicating with said inlet port and said activator means comprises a piston slidably retained within said cylinder, said piston moving in said cylinder and forcing said shuttle member into said open position in response to the application of fluid pressure at said inlet port.

8. A system according to claim 7 wherein said transfer means further comprises a channel defined by said housing means and extending between said outlet port and an orifice in said cylinder, said orifice being closed by said piston with said shuttle member in said closed position and opened to provide fluid communication between said inlet and outlet ports in response to movement of said piston that forces said shuttle member to said open position.

9. A system according to claim 8 including bias means for biasing said shuttle member in said closed position.

10. A system according to claim 9 wherein said shuttle member defines a vent opening extending through said divider wall.

11. A system according to claim 1 including a fire detector means located in each of said zones, an electrical control system responsive to signals from said detector means, and a pneumatic control system for applying fluid pressure to predetermined ones of said actuator means in response to control signals from such electrical control system.

* * * * *